US008436702B2

(12) United States Patent
Naka et al.

(10) Patent No.: US 8,436,702 B2
(45) Date of Patent: May 7, 2013

(54) ELECTROMAGNETIC CONTACTOR UNIT

(75) Inventors: Yasuhiro Naka, Kounosu (JP); Koji Okubo, Kounosu (JP); Kouetsu Takaya, Kounosu (JP); Kenji Suzuki, Kounosu (JP)

(73) Assignee: Fuji Electric FA Components & Systems Co., Ltd., Tokyo (JP)

( * ) Notice: Subject to any disclaimer, the term of this patent is extended or adjusted under 35 U.S.C. 154(b) by 0 days.

(21) Appl. No.: 13/500,407

(22) PCT Filed: Sep. 13, 2010

(86) PCT No.: PCT/JP2010/005585

§ 371 (c)(1), (2), (4) Date: Jun. 4, 2012

(87) PCT Pub. No.: WO2011/092762

PCT Pub. Date: Aug. 4, 2011

(65) Prior Publication Data

US 2012/0249271 A1 Oct. 4, 2012

(30) Foreign Application Priority Data

Jan. 27, 2010 (JP) ..... 2010-015215

(51) Int. Cl.

| | |
|---|---|
| ***H01H 9/02*** | (2006.01) |
| ***H01H 13/04*** | (2006.01) |
| ***H01H 9/00*** | (2006.01) |
| ***H01H 13/00*** | (2006.01) |
| ***H01H 9/20*** | (2006.01) |

(52) U.S. Cl.

USPC ..... 335/202; 200/294; 200/50.33; 361/605; 335/159

(58) Field of Classification Search ..... 335/159–161, 335/202; 200/50.33, 50.35, 294; 361/605, 361/609, 610, 615, 634, 636

See application file for complete search history.

(56) References Cited

U.S. PATENT DOCUMENTS

| | | | | |
|---|---|---|---|---|
| 3,177,331 | A * | 4/1965 | Kawabata et al. | 200/295 |
| 4,270,035 | A * | 5/1981 | Richter, Sr. | 200/294 |
| 4,883,927 | A * | 11/1989 | Apfelbacher et al. | 335/161 |
| 6,002,579 | A | 12/1999 | Drexler et al. | |
| 8,080,747 | B2 * | 12/2011 | Wang et al. | 335/120 |

FOREIGN PATENT DOCUMENTS

| | | |
|---|---|---|
| JP | S48-31564 | 4/1973 |
| JP | S60-98219 | 7/1985 |
| JP | H01-112512 | 7/1989 |
| JP | 2000-502208 A | 2/2000 |

* cited by examiner

*Primary Examiner* — Bernard Rojas
(74) *Attorney, Agent, or Firm* — Manabu Kanesaka

(57) ABSTRACT

There is provided an electromagnetic contactor unit capable of firmly connecting electromagnetic contactors without influencing outer dimensions when the electromagnetic contactors are connected to each other. The electromagnetic contactor unit connected at least two juxtaposed electromagnetic contactors (2*a*, 2*b*) with a connection piece (42). The electromagnetic contactor includes an attachment hole (41*a*) formed in each corner of an attachment plate portion, a piece accommodation concave portion (43) fitting a half portion of the connection piece formed above the attachment hole and accommodating within an outer dimension, and is opened to a connection surface with the adjacent electromagnetic contactor, and a locking portion (44) locking the connection piece formed in the piece accommodation concave portion. The connection piece includes a pair of engagement protrusions (42*b*, 42*c*) which are individually engaged with the adjacent attachment holes of the juxtaposed electromagnetic contactors, and a locked portion (42*k*) locked by the locking portion.

8 Claims, 9 Drawing Sheets

ELECTROMAGNETIC CONTACTOR UNIT

RELATED APPLICATIONS

The present application is National Phase of International Application No. PCT/JP2010/005585 filed Sep. 13, 2010, and claims priority from Japanese Application No. 2010-015215, filed Jan. 27, 2010.

TECHNICAL FIELD

The present invention relates to an electromagnetic contactor unit wherein a plurality of electromagnetic contactors is connected.

BACKGROUND ART

As a unit for connecting electromagnetic contactors to each other, a switch unit described in Patent Document 1 is known. In the switch unit, by fitting a connection changeover portion in slits in connection-side side surfaces of two juxtaposed switches, when one of the switches is brought into a turned-on state, the transition of the other switch to the turned-on state is prevented. In addition, there are provided E-shaped clamps each of which has a central shaft and a pair of leg portions sandwiching the central shaft, and there are formed ribs having concave portions in opposing surfaces formed at end portions of the connection-side side surfaces of the two switches. Each of the clamps is attached from the outside such that the central shaft is fitted in the concave portion and the leg portions hold the rib between them from a side opposite to the side of the concave portion of the rib, and the two switches are thereby integrated.

Patent Document 1: Japanese Translation of PCT Application No. 2000-502208

DISCLOSURE OF THE INVENTION

However, in the conventional art described in Patent Document 1 described above, in order to integrate the juxtaposed switches, the clamps are attached to the ribs having the concave portions formed in the connection-side side surfaces of the switches from the outside. Accordingly, in a state where the clamps are attached to the switches, the clamps protrude to the outside of the switches, and there arises an unsolved problem that the outer dimensions of the combined switches are increased.

In view of the foregoing, the present invention has been achieved by focusing on the unsolved problem of the conventional art described above, and an object thereof is to provide an electromagnetic contactor unit capable of firmly connecting electromagnetic contactors without influencing outer dimensions when the electromagnetic contactors are connected to each other.

In order to achieve the above-described object, an electromagnetic contactor unit according to an embodiment of the present invention is connected at least two juxtaposed electromagnetic contactors with a connection piece. Each of the electromagnetic contactors includes an attachment hole which is formed in each corner of an attachment plate portion, a piece accommodation concave portion fitting a half portion of the connection piece formed above the attachment hole and accommodating within an outer dimension, and is opened in a connection surface with the adjacent electromagnetic contactor, and a locking portion locking the connection piece formed in the piece accommodation concave portion. In addition, the connection piece includes a pair of engagement protrusions individually engaged with the adjacent attachment holes of the juxtaposed electromagnetic contactors, and a locked portion locked by the locking portion.

According to the structure, by attaching the connection piece in the piece accommodation concave portions of the juxtaposed electromagnetic contactors, the electromagnetic contactors are integrated. At this point, the connection piece fits within the outer dimensions of the electromagnetic contactor, and hence the outer dimensions of the connected electromagnetic contactors are not increased. In addition, since the pair of engagement protrusions of the connection piece is engaged with the attachment holes formed in the attachment plate portions of the electromagnetic contactors, and the locked portion is locked by the locking portion formed in the piece accommodation concave portion, even when an external force which displaces the connected electromagnetic contactors in mutually opposite directions is applied to the electromagnetic contactors in any direction, it is possible to prevent the displacement between the electromagnetic contactors.

In the electromagnetic contactor unit according to another aspect of the present invention, the connection piece at least includes an attachment plate portion formed with the pair of engagement protrusions on one surface, a pair of side plate portions formed on the other surface of the attachment plate portion, a front plate portion connecting attachment plate portion sides of the pair of side plate portions, and a curve portion curved from a tip of the front plate portion to the rearward side and has the locked portion formed to protrude at its tip.

According to the structure, since the curve portion can secure elasticity, and the curve portion is formed with the locked portion protruding toward the side opposite to the side of the engagement protrusion at its tip, by causing the locked portion to be locked by the locking portion formed in the piece accommodation concave portion of the electromagnetic contactor, the movement of the connection piece from the piece accommodation concave portion to the side opposite to the side of the engagement protrusion is regulated.

Also, in the electromagnetic contactor unit according to another aspect of the present invention, the piece accommodation concave portion is formed of a concave portion which allows a tool for tightening a screw inserted into the attachment hole to be inserted thereinto.

According to the structure, since the concave portion is formed for allowing an insertion of a tool for tightening the screw inserted into the attachment hole when the electromagnetic contactor is attached to a base or the like such as a driver or the like, it is not necessary to newly form space for accommodating the connection piece.

In the electromagnetic contactor unit according to yet another aspect of the present invention, a holding protrusion formed between the pair of engagement protrusions of the connection piece is inserted between the adjacent electromagnetic contactors and serves as a holding portion by cooperating with the pair of engagement protrusions.

According to the structure, it is possible to hold portions between the connection surfaces and the attachment holes of the attachment plate portions of the electromagnetic contactors between the engagement protrusions and the holding protrusion of the connection piece, and thereby connect the electromagnetic contactors to each other more firmly.

Also, in the electromagnetic contactor unit according to another aspect of the present invention, each of the pair of engagement protrusions is formed into a C-shaped tubular shape formed by notching a cylindrical portion thereof on a side of a contact surface with the piece accommodation portion, and having a tapered portion formed on an outer peripheral surface of a tip side thereof.

According to the structure, since the engagement protrusion is formed into the C-shaped tubular shape, it becomes possible to bend the engagement protrusion when the engagement protrusion is inserted into the attachment hole of the electromagnetic contactor so that the engagement with the attachment hole is facilitated, and since the tapered portion is formed at the tip, the engagement with the attachment hole is further facilitated.

According to the present invention, when electromagnetic contactors are juxtaposed and connected, piece accommodation concave portions are formed in the electromagnetic contactors, a connection piece is accommodated in the piece accommodation concave portions on connection surface sides of the electromagnetic contactors to be connected, a pair of engagement protrusions of the connection piece is engaged with adjacent attachment holes of the electromagnetic contactors, and locked portions are locked by locking portions formed in the piece accommodation concave portions, whereby it is possible to firmly connect the electromagnetic contactors to each other without causing the connection piece to protrude from a range of outer dimensions of the electromagnetic contactors.

BEST MODE FOR CARRYING OUT THE INVENTION

A description is given hereinbelow of an embodiment of the present invention with reference to the drawings.

Figure 1:
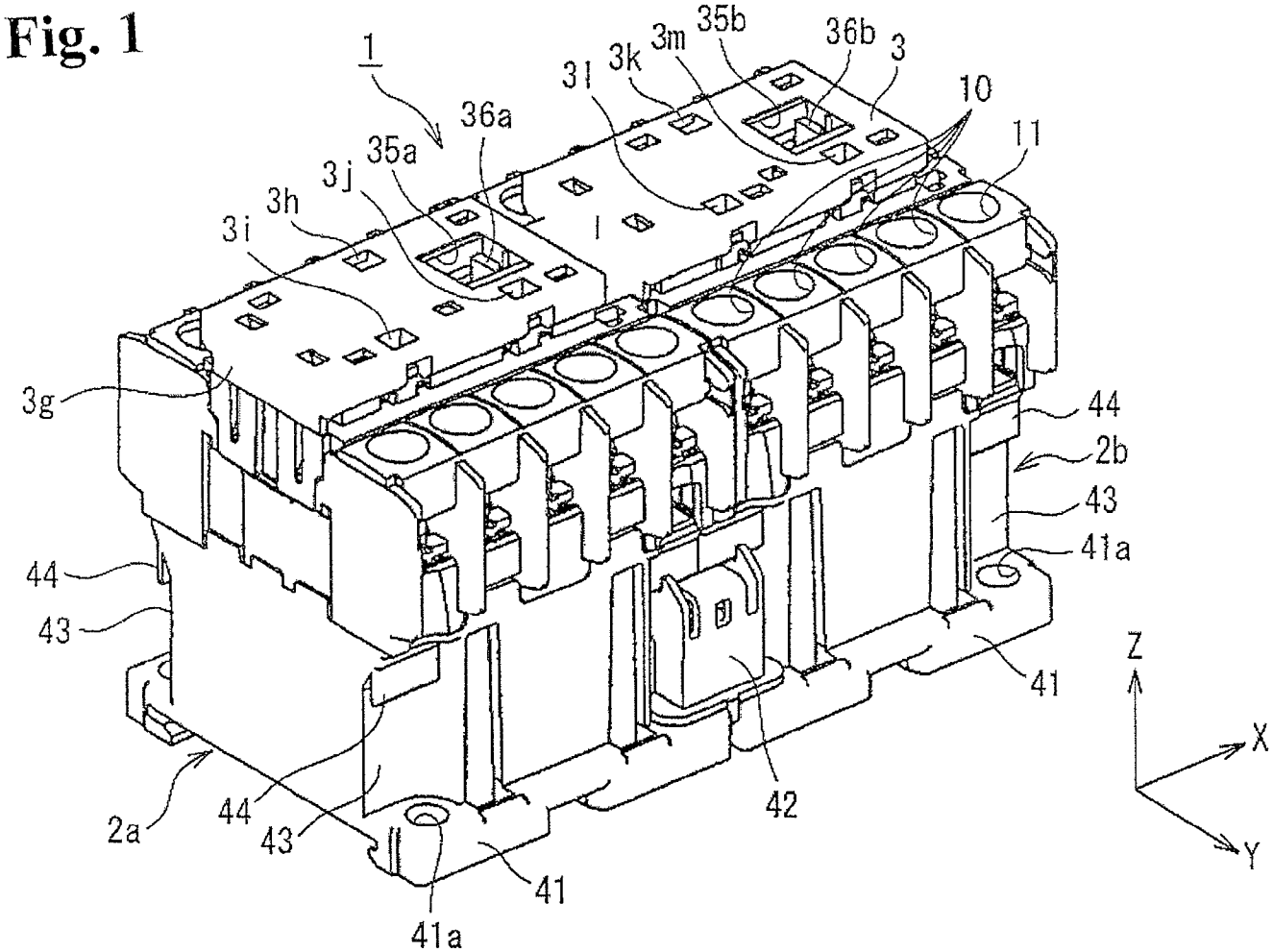
FIG. 1 is a perspective view showing an electromagnetic contactor unit according to the present invention.
Figure 2:
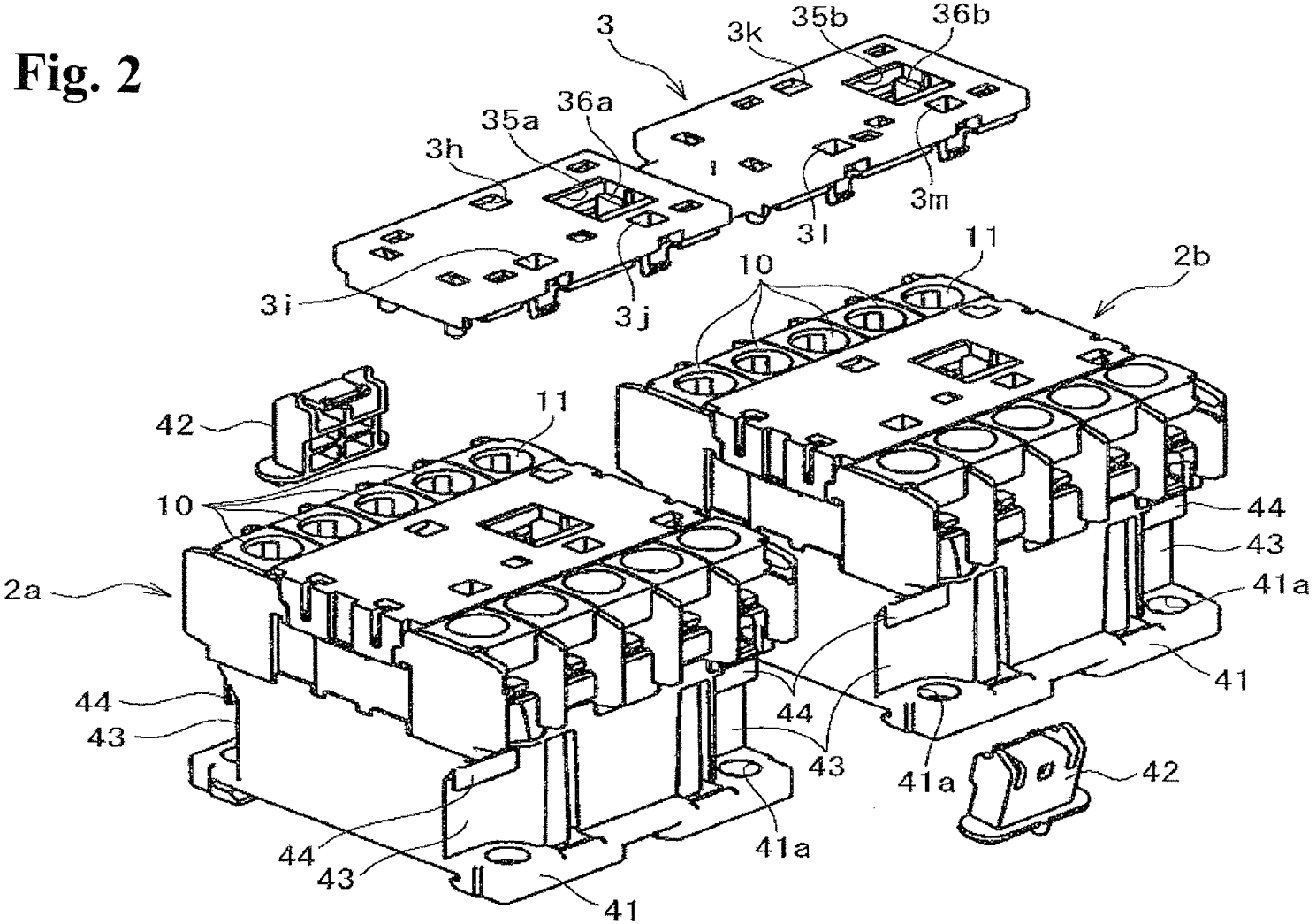
FIG. 2 is an exploded perspective view of the electromagnetic contactor unit of FIG. 1.

FIG. 1 is a perspective view showing an electromagnetic contactor unit which is connected to a feeder circuit of, e.g., a three-phase induction motor (not shown), and controls a forward/reverse operation of the induction motor, while FIG. 2 is a developed perspective view of FIG. 1.

An electromagnetic contactor unit 1 comprises two electromagnetic contactors 2*a* and 2*b* and one reversible unit 3.

One electromagnetic contactor 2*a* of the two electromagnetic contactors 2*a* and 2*b* is an electromagnetic contactor which controls a forward rotation of the induction motor, while the other electromagnetic contactor 2*b* is an electromagnetic contactor which controls a reverse rotation of the induction motor.

Figure 3:
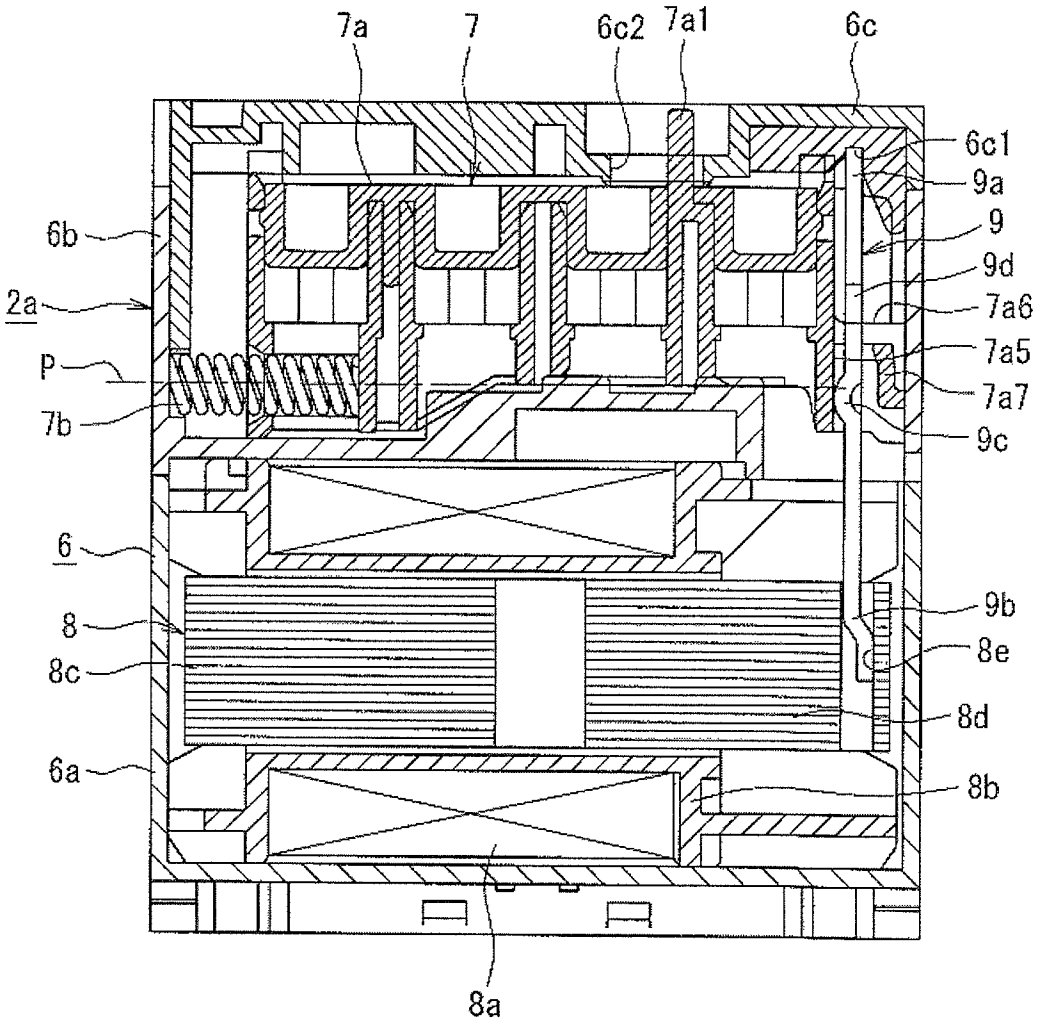
FIG. 3 is a cross-sectional view showing an electromagnetic contactor.

As shown in FIG. 2, the electromagnetic contactor 2*a* is a device which includes terminal portions 10 each having a contact and a coil terminal portion 11 on its upper surface and, as shown in FIG. 3, a contact portion 7, an electromagnet 8, and a drive lever 9 are accommodated in a main body case 6.

The main body case 6 has a lower case 6*a* which accommodates the electromagnet 8, an upper case 6*b* which accommodates the contact portion 7, and an arc extinguishing cover 6*c* which covers the upper portion of the upper case 6*b*.

The arc extinguishing cover 6*c* is formed with a rectangular display window 6*c*2 which communicates with the front and back sides of the arc extinguishing cover 6*c*, and a movement display piece 7*a*1 of the contact portion 7 is protruded to the upper surface through the display window 6*c*2. In addition, in the arc extinguishing cover 6*c*, connection holes 12 to 14 which allow connection of the one reversible unit 3 are formed to extend through the arc extinguishing cover 6*c* in a front and back direction. The connection holes 12 to 14 are quadrilateral holes.

As shown in FIG. 3, the contact portion 7 comprises a movable contact support 7*a* which is disposed in the upper case 6*b* so as to be slidable in a predetermined direction, and a return spring 7*b* which presses the movable contact support 7*a* in one direction.

The electromagnet 8 has an exiting coil 8*a* wound therearound, and includes a tubular coil frame 8*b* which has an axial direction set in parallel with a sliding direction of the movable contact support 7*a*, a fixed core 8*c* which is inserted into a hollow portion of the coil frame 8*b* and is fixed on a side wall of the lower case 6*a*, and a movable core 8*d* which opposes the fixed core 8*c* so as to be movable close to or away from the fixed core 8*c* and is inserted into the hollow portion of the coil frame 8*b*.

In addition, in order to transmit an attraction movement and a release movement of the movable core 8*d* to the movable contact support 7*a*, as shown in FIG. 3, the drive lever 9 connects between the side of the movable contact support 7*a* opposite to the side of the return spring 7*b* and the movable core 8*d* of the electromagnet 8.

The drive lever 9 is a plate-like member, its upper end in a longitudinal direction serves as a rotation shaft portion 9*a*, the other end side thereof in the longitudinal direction is formed with a movable core connection portion 9*b*, and the central portion thereof in the longitudinal direction is provided with a movable contact support connection portion 9*c*. Further, a pair of supported portions 9*d* is formed at positions closer to the rotation shaft portion 9*a* than the movable contact support connection portion 9*c*.

The movable core connection portion 9*b* of the drive lever 9 is inserted into a connection hole 8*e* formed in the movable core 8*d* from above, and is connected to the movable core 8*d*. In addition, the rotation shaft portion 9*a* of the drive lever 9 enters into a shaft concave portion 6*c*1 provided in the lower surface of the arc extinguishing cover 6*c* and is rotatably connected to the arc extinguishing cover 6*c*.

Note that the other electromagnetic contactor 2*b* has the same structure as that of one electromagnetic contactor 2*a* so that the detailed description thereof is omitted.

The reversible unit 3 disposes the two electromagnetic contactors 2*a* and 2*b* so as to be adjacent to each other and fixes them, and serves as an interlock device which mechanically locks the two electromagnetic contactors 2*a* and 2*b* so as to prevent the two electromagnetic contactors 2*a* and 2*b* from being simultaneously brought into a close (ON) state even when an operation signal is inputted to both of the two electromagnetic contactors 2*a* and 2*b* by any operation (even when the electromagnets 8 of the two electromagnetic contactors 2*a* and 2*b* simultaneously attempt to operate).

Figure 4:
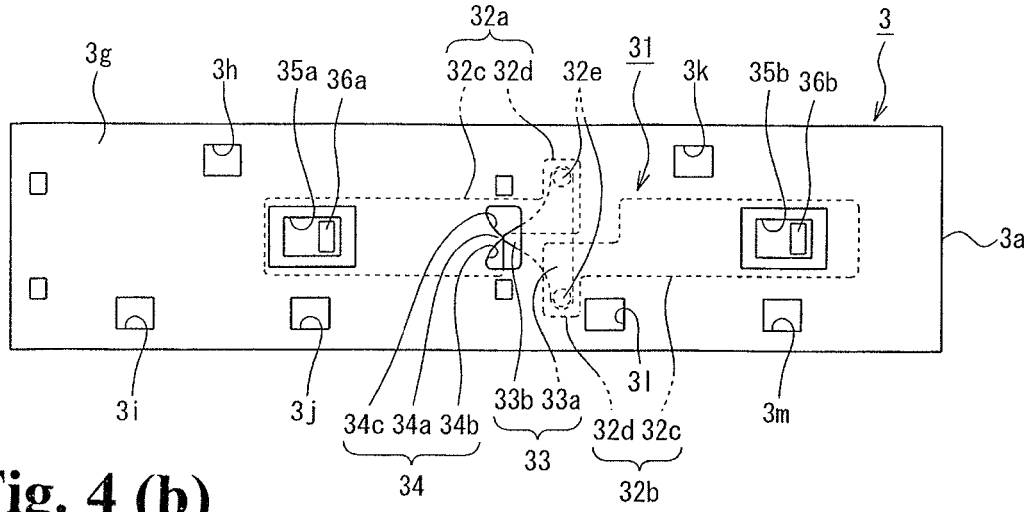
FIGS. 4(*a*) to 4(*c*) are plan views for explaining an operation of a reversible unit, wherein FIG. 4(*a*) shows a release state, FIG. 4(*b*) shows a left-side turned-on state, and FIG. 4(*c*) shows a right-side turned-on state.
Figure 4:
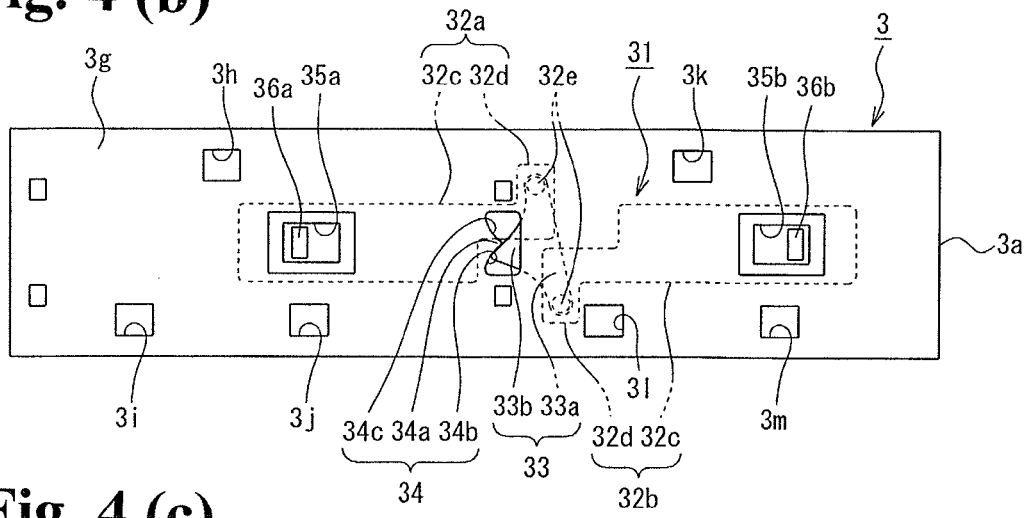
Figure 4:
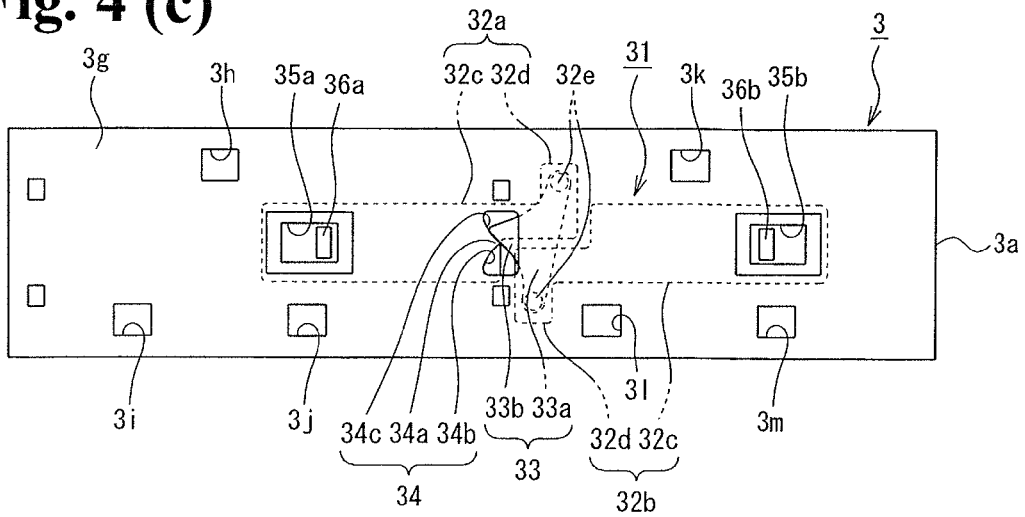

As shown in FIGS. 4(*a*)-4(*c*), the reversible unit 3 includes a rectangular parallelepiped unit main body 3*a*, and snap pieces 3*c* to 3*f* each having a claw portion with its tip protruding outward which protrude from a contactor attachment portion 3*b* on the back surface side of the unit main body 3*a* which contact with the arc extinguishing covers 6*c* of the adjacently disposed two electromagnetic contactors 2*a* and 2*b*.

In addition, in the reversible unit 3, as shown in FIGS. 1 and 2, there are formed connection holes 3*h*, 3*i*, 3*j*, 3*k*, 3*l*, and 3*m* with which hook pieces of an auxiliary contact unit which is not shown are engaged on the front surface side of the unit main body 3*a*.

Further, in the unit main body 3*a*, as shown in FIGS. 4(*a*)-4(*c*), there is provided an interlock mechanism 31 which mechanically locks the two electromagnetic contactors 2*a* and 2*b* so as to prevent the two electromagnetic contactors 2*a* and 2*b* from being simultaneously brought into the close (ON) state. The interlock mechanism 31 comprises slide members 32*a* and 32*b* which are individually connected to the movement display pieces 7*a*1 of the electromagnetic contactors 2*a* and 2*b* and slidable in a connecting direction, i.e., a longitudinal direction of the electromagnetic contactors 2*a* and 2*b*, a slide regulation member 33 which connects between opposing portions of the slide members 32*a* and 32*b* on the side of one of front and back surfaces and regulates the slide of one of the slide members 32*a* and 32*b* while allowing the slide of the other, and a rotation regulation member 34 which opposes the slide regulation member 33 and regulates its rotation.

The slide members 32*a* and 32*b* are formed into identical shapes which are point-symmetric when viewed two-dimensionally, and each of the slide member 32*a* and 32*b* comprises a rectangular plate portion 32*c* and a hook-like portion 32*d* which is formed outside the inside end of the rectangular plate portion 32*c* and is bent outward in a direction orthogonal to a longitudinal direction. In addition, in a release state (unlocked state), as shown in FIG. 4(*a*), the slide members 32*a* and 32*b* are disposed such that their respective hook-like portions 32*d* oppose each other back to back.

The slide regulation member 33 comprises a base portion 33*a* which is engaged with engagement pins 32*e* formed on the sides of the outward ends of the hook-like portions 32*d* of the slide members 32*a* and 32*b*, and a triangular protrusion portion 33*b* which protrudes from the central portion of the base portion 33*a* toward the slide member 32*a*.

The rotation regulation member 34 at least includes, in the unit main body 3*a*, a top portion 34*a* which closely opposes the top portion of the triangular protrusion portion 33*b* of the slide regulation member 33 in the release state, a rotation regulation wall portion 34*b* which is formed of an arc surface which passes through the top portion 34*a* and is along the trajectory of the movement of the top portion of the triangular protrusion portion 33*b* when the slide member 32*a* is slid from the release state, and a rotation regulation wall portion 34*c* which is formed of an arc surface which passes through the top portion 34*a* and is along the trajectory of the movement of the top portion of the triangular protrusion portion 33*b* when the slide member 32*b* is slid from the release state.

Figure 5:
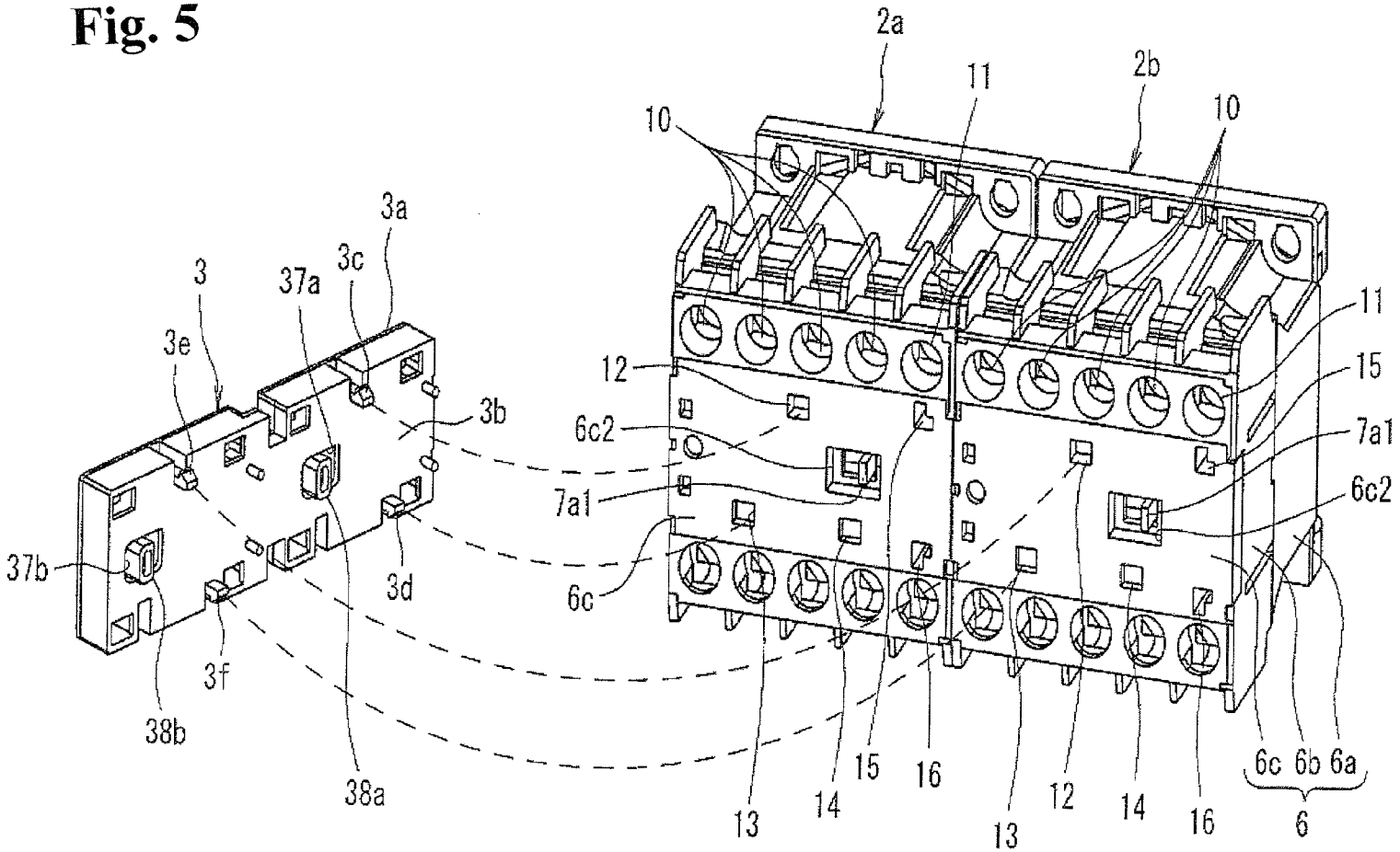
FIG. 5 is a perspective view showing the reversible unit and the electromagnetic contactors before attachment.

In addition, on the front surface sides of the slide members 32*a* and 32*b*, as shown in FIGS. 1 and 2, there are formed movement display pieces 36*a* and 36*b* which protrude from rectangular unit windows 35*a* and 35*b* formed in the surface of the unit main body 3*a*. Further, on the back surface sides of the slide members 32*a* and 32*b*, as shown in FIG. 5, there are formed tubular display piece engagement portions 38*a* and 38*b* which protrude from rectangular unit windows 37*a* and 37*b* formed in the back surface of the unit main body 3*a*.

Furthermore, in a state where each of the above-described electromagnetic contactors 2*a* and 2*b* is in an open (OFF) state, the reversible unit 3 is attached onto the electromagnetic contactors 2*a* and 2*b*. In the attachment of the reversible unit 3, firstly, while the display piece engagement portions 38*a* and 38*b* are engaged with the movement display pieces 7*a*1 of the electromagnetic contactors 2*a* and 2*b*, the tip of the snap piece 3*c* of the reversible unit 3 is inserted into the connection hole 12 of the electromagnetic contactor 2*a* and engaged with an opening peripheral edge. Subsequently, the tip of the snap piece 3*d* is inserted into the connection hole 13 of the electromagnetic contactor 2*a* and engaged with an opening peripheral edge, the tip of the snap piece 3*e* is inserted into the connection hole 12 of the electromagnetic contactor 2*b* and engaged with an opening peripheral edge, the tip of the snap piece 3*f* is inserted into the connection hole 13 of the electromagnetic contactor 2*b* and engaged with an opening peripheral edge, and the reversible unit 3 is thereby attached onto the electromagnetic contactors 2*a* and 2*b*.

In the state of the attachment of the reversible unit 3, both of the electromagnetic contactors 2*a* and 2*b* are in the open (OFF) state. Consequently, as shown in FIG. 4(*a*), both of the slide members 32*a* and 32*b* are at positions to which the slide member 32*a* and 32*b* have moved rightward, the interlock mechanism 31 is in the release state, and the base portion 33*a* of the slide regulation member 33 is oriented in a direction generally orthogonal to the longitudinal direction. Therefore, the top portion of the triangular protrusion portion 33*b* in the slide regulation member 33 of the interlock mechanism 31 closely opposes the top portion 34*a* of the rotation regulation member 34, and the slide regulation member 33 is allowed to rotate about one end of the base portion 33*a*.

In the release state of the interlock mechanism 31, when the electromagnetic contactor 2*a* is brought into the close (ON) state, the movable core 8*d* of the electromagnetic contactor 2*a* is attracted by the fixed core 8*c* and moved. In response to this, the movable contact support 7*a* of the contact portion 7 is moved against the return spring 7*b* via the drive lever 9, and the electromagnetic contactor 2*a* is brought into a turned-on state.

Thus, when the electromagnetic contactor 2*a* is brought into the turned-on state, the movement display piece 7*a*1 of the contact portion 7 of the electromagnetic contactor 2*a* moves from an open (OFF) position shown in FIG. 4(*a*) to a close position shown in FIG. 4(*b*). Since the slide member 32*a* of the reversible unit 3 is connected to the movement display piece 7*a*1, as shown in FIG. 4(*b*), the slide member 32*a* moves from the open (OFF) position shown in FIG. 4(*a*) to the close position, and a left-side turned-on state is established. Consequently, the slide regulation member 33 rotates in a counterclockwise direction in which the slide regulation member 33 rotates about the engagement pin 32*e* of the slide member 32*b*, and the triangular protrusion portion 33*b* contacts with or closely opposes the rotation regulation wall portion 34*b* of the rotation regulation member 34.

In the left-side turned-on state, the triangular protrusion portion 33*b* of the slide regulation member 33 is in contact with or closely opposes the rotation regulation wall portion 34*b* of the rotation regulation member 34. Consequently, when it is intended to bring the electromagnetic contactor 2*b* on the right side into the close (ON) state, the slide member 32*b* of the interlock mechanism 31 attempts to move from the open (OFF) position shown in FIG. 4(*b*) to the close (ON) position on the side of the slide member 32*b* via the movement display piece 7*a*1 of the electromagnetic contactor 2*b*. Accordingly, although the slide regulation member 33 attempts to rotate about the engagement pin 32*e* of the slide member 32*a* in a clockwise direction, the triangular protrusion portion 33*b* contacts with the rotation regulation wall portion 34*b* of the rotation regulation member 34, and the rotation of the slide regulation member 33 is thereby prevented. As a result, when the electromagnetic contactor 2*a* on the left side is in the close (ON) state, the transition of the electromagnetic contactor 2*b* on the right side to the close (ON) is reliably prevented.

Similarly, in the state where the interlock mechanism 31 of the reversible unit 3 is in the release state as shown in FIG. 4(*a*), as shown in FIG. 4(*c*), when the electromagnetic contactor 2*b* on the right side is brought into the close (ON) state, the slide member 32*b* of the interlock mechanism 31 slides toward the slide member 32*a* via the movement display piece 7*a*1 of the electromagnetic contactor 2*b*. In response to this, the slide regulation member 33 rotates about the engagement pin 32*e* of the slide member 32*a* in the clockwise direction, and the triangular protrusion portion 33*b* comes in contact with or closely opposes the rotation regulation wall portion 34*c* of the rotation regulation member 34. Consequently, the rotation of the slide regulation member 33 in the counterclockwise direction is regulated, and the slide of the slide member 32*a* in a direction moving away from the slide member 32*b* is thereby regulated. Therefore, the transition of the electromagnetic contactor 2*a* on the left side from the open (OFF) state to the close (ON) state is reliably prevented.

Thus, in the case where the two electromagnetic contactors 2*a* and 2*b* are juxtaposed and the reversible unit 3 is attached to their arc extinguishing covers 6*c*, in order to connect the electromagnetic contactors 2*a* and 2*b* more firmly, a connection structure is employed in which attachment plate portions 41 formed in the lower cases 6*a* which attach the electromagnetic contactors 2*a* and 2*b* to a base are connected using a connection piece 42, and the electromagnetic contactors 2*a* and 2*b* are connected more firmly.

Figure 6:
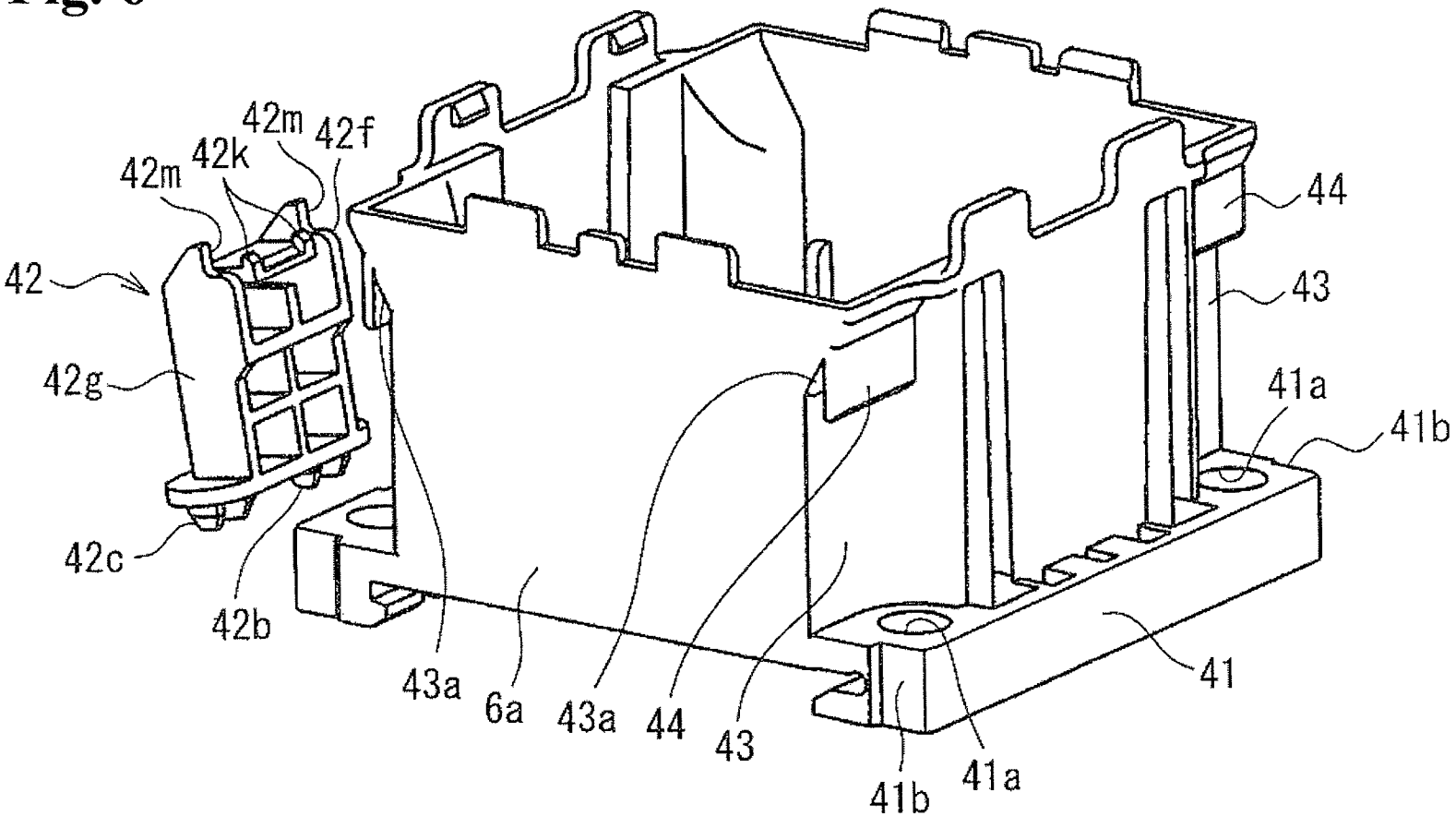
FIG. 6 is a perspective view showing a lower frame of the electromagnetic contactor.

In the connection structure, as shown in FIG. 6, attachment holes 41*a* for inserting attachment screws (not shown) used when attaching the electromagnetic contactors 2*a* and 2*b* to the base are formed on four corners of the attachment plate portion 41 in the lower case 6*a* of each of the electromagnetic contactors 2*a* and 2*b*. In addition, in the attachment plate portion 41, there is formed a notch portion 41*b* on the side of the end portion of each attachment hole 41*a* in an axial direction of the electromagnet 8. Further, above each attachment hole 41*a*, there is formed a piece accommodation concave portion 43 which allows a tool for tightening the attachment screw inserted into the attachment hole a such as a driver or the like to be inserted thereinto, and accommodates the connection piece 42. The piece accommodation concave portion 43 is formed so as to surround the attachment hole 41*a* from the inside in two directions, and there is formed a locking piece 44 as a locking portion which protrudes downward on an inclined upper surface 43*a* of the piece accommodation concave portion 43. Furthermore, as described later, the piece accommodation concave portion 43 is formed such that, in a state where the piece accommodation concave portion 43 accommodates a half portion of the connection piece 42, the outer surface of the connection piece 42 fits within outer dimensions of the electromagnetic contactors 2*a* and 2*b*.

Figure 7:
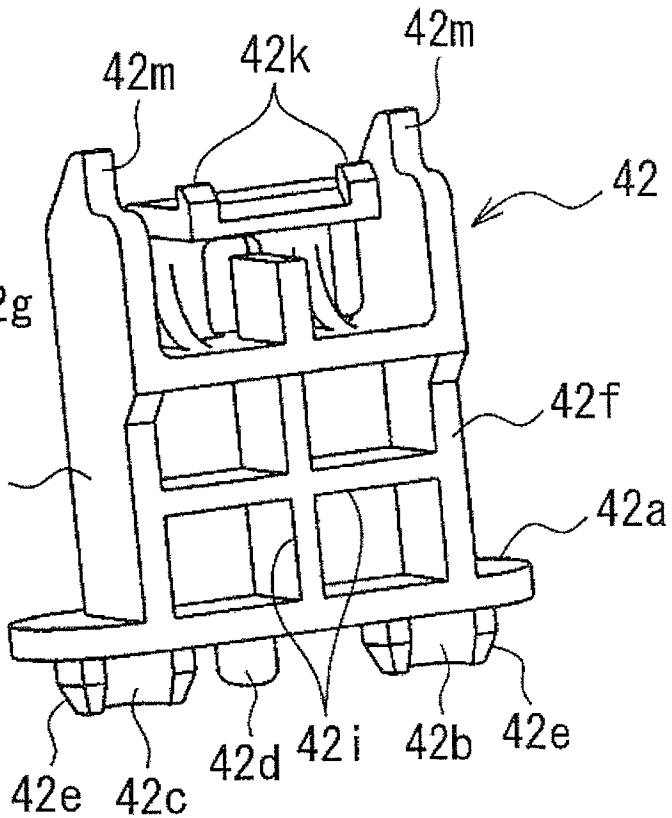
FIGS. 7(*a*) and 7(*b*) are perspective views showing a connection piece, wherein FIG. 7(*a*) is a perspective view on the front side and FIG. 7(*b*) is a perspective view on the back side.
Figure 7:
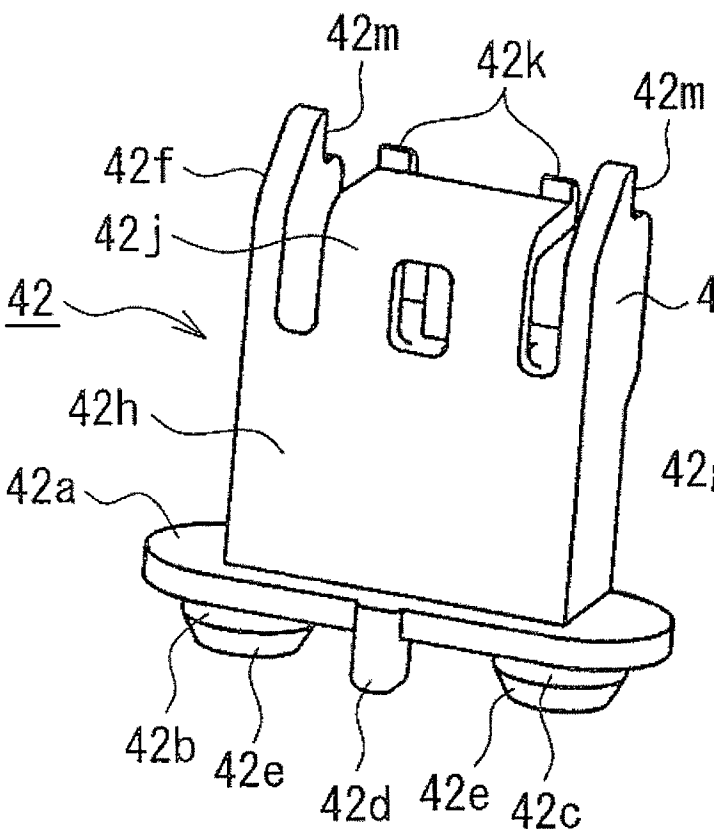

The connection piece 42 is formed by, e.g., mold forming using a synthetic resin material and, as shown in FIG. 7(*a*), a pair of engagement protrusions 42*b* and 42*c* to be engaged with the attachment holes 41*a* of the juxtaposed electromagnetic contactors 2*a* and 2*b* is formed to protrude on the lower surface side of an oblong attachment plate portion 42*a*. At a middle position between the engagement protrusions 42*b* and 42*c*, there is formed, e.g., a cylindrical holding protrusion 42*d* which forms a holding portion together with the engagement protrusions 42*b* and 42*c*. Herein, as shown in FIG. 7(*b*), each of the engagement protrusions 42*b* and 42*c* is formed into a C-shaped tubular shape obtained by notching its cylindrical portion on the side of the surface opposing the piece accommodation concave portion 43 of each of the electromagnetic contactors 2*a* and 2*b*, and is formed with a tapered portion 42*e* on the side of its lower end.

In addition, above the attachment plate portion 42*a*, there are formed side plate portions 42*f* and 42*g* which extend upward at positions corresponding to generally central portions of the engagement protrusions 42*b* and 42*c*, lower end sides of the side plate portions 42*f* and 42*g* are connected to each other by a front plate portion 42*h*, and the back surface side of the front plate portion 42*h* is formed with lattice-like frame portions 42*i*, whereby the mechanical strength is secured.

On the upper end side of each of the side plate portions 42*f* and 42*g*, there is formed a curve portion 42*j* which extends upward from the upper end of the front plate portion 42*h* and then extends backward toward the piece accommodation concave portion 43 of each of the electromagnetic contactors 2*a* and 2*b*. At the tip of the curve portion 42*j*, there are formed hook portions 42*k* which slightly protrude upward and serve as a pair of locked portions to be locked inside the above-described locking piece 44 formed in the upper portion of the piece accommodation concave portion 43. Further, at the tip portions of the side plate portions 42*f* and 42*g*, there are formed engagement portions 42*m* which are engaged with the front sides of the locking pieces 44.

Next, a description is given of the operation of the above-described embodiment.

In order to attach the reversible unit 3 to the pair of electromagnetic contactors 2*a* and 2*b*, as shown in FIG. 5, in the state where the pair of electromagnetic contactors 2*a* and 2*b* is juxtaposed in the same direction, mutual side walls are firstly brought into contact with each other. In this state, the electromagnet 8 of each of the electromagnetic contactors 2*a* and 2*b* is in a non-energized state, and the movable contact support 7*a* of the contact portion 7 is pressed by the return spring 7*b* and each of the electromagnetic contactors 2*a* and 2*b* is maintained to be in the open (OFF) state. Consequently, as shown in FIG. 5, each of the movement display pieces 7*a*1 of the electromagnetic contactors 2*a* and 2*b* indicates the open position on the right side.

Subsequently, in a state where the reversible unit 3 is set such that the movement display pieces 36*a* and 36*b* are at the open positions on the right side, the snap pieces 3*c* and 3*d* and the snap pieces 3*e* and 3*f* of the reversible unit 3 are caused to oppose the connection holes 12 and 13 formed in the arc extinguishing cover 6*c* of the electromagnetic contactor 2*a* and the connection holes 12 and 13 formed in the arc extinguishing cover 6*c* of the electromagnetic contactor 2*b*, respectively.

In this state, the reversible unit 3 is pushed down toward the electromagnetic contactors 2*a* and 2*b*, whereby the snap pieces 3*c* and 3*d* and the snap pieces 3*e* and 3*f* are inserted into the connection holes 12 and 13 of the electromagnetic contactors 2*a* and 2*b* and locked, and the display piece engagement portions 38*a* and 38*b* of the reversible unit 3 are engaged with the movement display pieces 7*a*1 of the electromagnetic contactors 2*a* and 2*b*.

Figure 8:
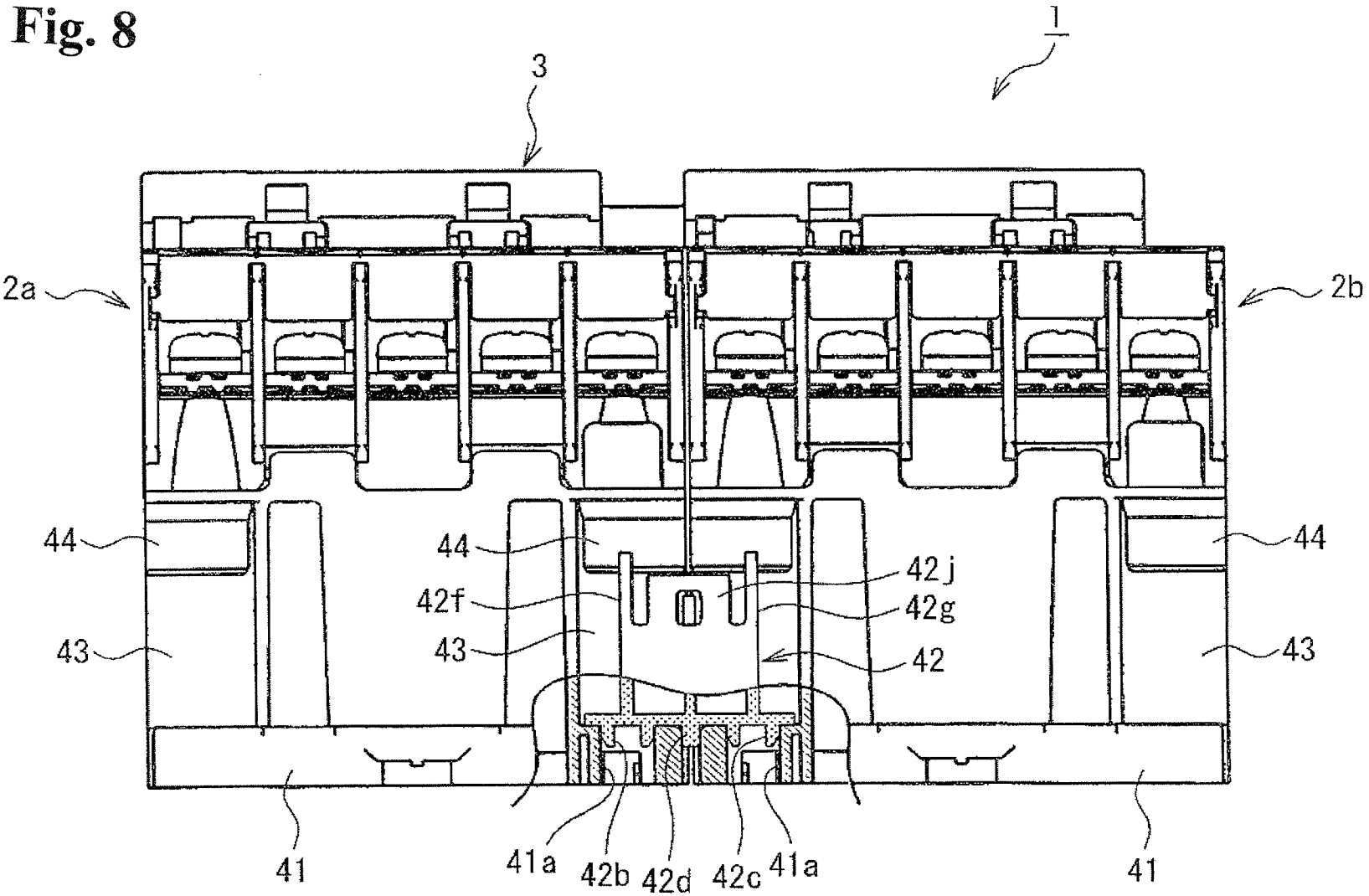
FIG. 8 is a plan view showing a cross section of a principal portion in a state where the electromagnetic contactors are connected using the connection piece.
Figure 9:
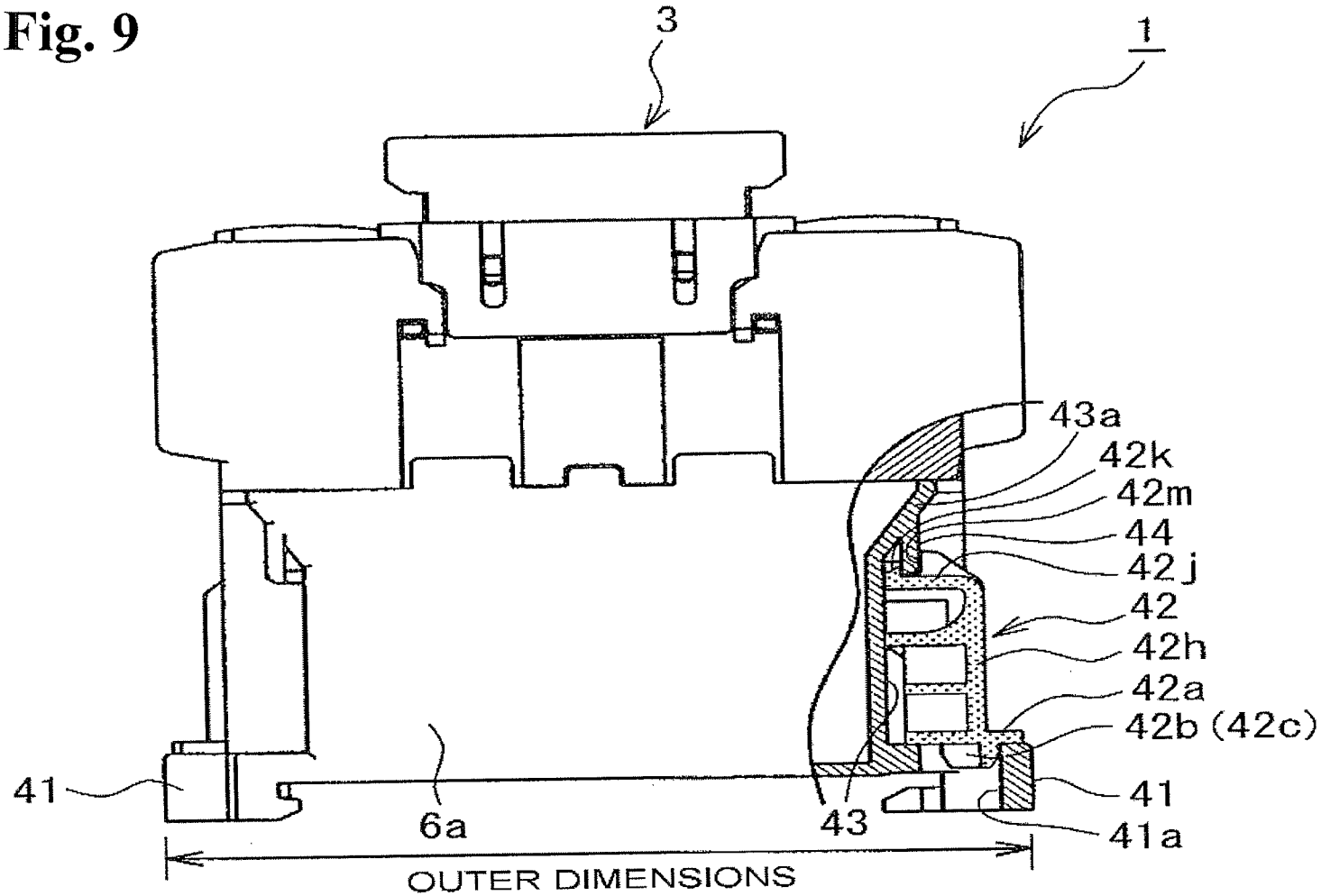
FIG. 9 is a side view showing a cross section of a principal portion in the state where the electromagnetic contactors are connected using the connection piece.

Subsequently or before the reversible unit 3 is attached, the attachment plate portions 41 at the connection positions of the electromagnetic contactors 2*a* and 2*b* are connected using the two connection pieces 42 disposed at the front and the rear. In the connection using the connection piece 42, as shown in FIGS. 8 and 9, in a state where the back side of the connection piece 42 is firstly faced toward the side of the piece accommodation concave portion 43, while the engagement protrusions 42*b* and 42*c* and the holding protrusion 42*d* formed on the lower surface side of the connection piece 42 are engaged with the attachment holes 41*a* of the electromagnetic contactors 2*a* and 2*b*, the holding protrusion 42*d* is inserted between the notch portions 41*b* formed in the attachment plate portions 41 of the electromagnetic contactors 2*a* and 2*b*. With this, the holding protrusion 42*d* and the engagement protrusions 42*b* and 42*c* hold portions between the attachment holes 41*a* and the notch portions 41*b* in the attachment plate portions 41 of the electromagnetic contactors 2*a* and 2*b* therebetween. At this point, since each of the engagement protrusions 42*b* and 42*c* of the connection piece 42 is formed into the C-shaped tubular portion, each of the engagement protrusions 42*b* and 42*c* can bend, and since the tip of each of the engagement protrusions 42*b* and 42*c* is formed with the tapered portion 42*e*, it is possible to easily perform the engagement with the attachment hole 41*a*.

Subsequently, the curve portion 42*j* of the connection piece 42 is bent, the hook portions 42*k* are inserted into the back sides of the locking pieces 44 formed in the upper portions of the piece accommodation concave portions 43 of the electromagnetic contactors 2*a* and 2*b*, and the engagement portions 42*m* at the tips of the side plate portions 42*f* and 42*g* are engaged with the front sides of the locking pieces 44 to release the bending of the curve portion 42*j*, whereby the locking pieces 44 are held between and fixed by the hook portions 42*k* and the engagement portions 42*m*.

Thus, by firmly connecting the sides of the attachment plate portions 41 of the electromagnetic contactors 2*a* and 2*b* using the two connection pieces 42, it is possible to adequately resist an external force in an X direction shown in FIG. 1 which is a direction moving the electromagnetic contactors 2*a* or 2*b* away from the connection surface by the individual engagement of the engagement protrusions 42*b* and 42*c* with the attachment holes 41*a* of the electromagnetic contactors 2*a* and 2*b*.

In addition, when an external force in a Y direction which displaces the electromagnetic contactors 2*a* and 2*b* in mutually opposite directions acts, the engagement protrusions 42*b* and 42*c* of the connection piece 42 are engaged with the attachment holes 41*a* of the attachment plate portions 41 of the electromagnetic contactors 2*a* and 2*b*, and the hook portions 42*k* serving as the locked portions and the engagement portions 42*m* of the side plate portions 42*f* and 42*g* hold the locking pieces 44 formed in the upper portions of the piece accommodation concave portions 43 therebetween, whereby it is possible to adequately resist the external force.

Further, when an external force in a Z direction which displaces the electromagnetic contactors 2*a* and 2*b* in mutually opposite directions acts, the attachment plate portion 42*a* formed with the engagement protrusions 42*b* and 42*c* contacts with the attachment plate portion 41 in one electromagnetic contactor 2*a* (or 2*b*), and the engagement portions 42*m* of the side plate portions 42*f* and 42*g* contact with the locking piece 44 in the other electromagnetic contactor 2*b* (or 2*a*). Consequently, it is possible to adequately resist the external force which displaces the electromagnetic contactors 2*a* and 2*b* in mutually opposite directions. Also, when an external force in a twisting direction acts on the electromagnetic contactors 2*a* and 2*b*, similarly to the above-described cases, it is possible to adequately resist the external force.

Note that, in order to separate the connected electromagnetic contactors 2*a* and 2*b* from each other, in a state where the reversible unit 3 is detached and the hook portions 42*k* are removed from the back surfaces of the locking pieces 44 formed in the upper portions of the piece accommodation concave portions 43 by bending the curve portion 42*j* of the connection piece 42 downward, the connection piece 42 is rotated so as to be moved away from the piece accommodation concave portions 43, and it is thereby possible to easily separate the connection piece 42 from the piece accommodation concave portions 43.

In addition, since the reversible unit 3 is attached to the upper surfaces of the electromagnetic contactors 2*a* and 2*b* on the side opposite to the side of the connection piece 42, it is possible to connect the electromagnetic contactors 2*a* and 2*b* to each other and hold them more firmly.

Further, since the connection piece can be formed by integral molding such as mold forming or the like, it is possible to easily manufacture the connection piece.

Furthermore, since the concave portion for inserting a tool for tightening an attachment screw inserted into the attachment hole 41*a* such as a driver or the like is utilized as the piece accommodation concave portion 43 of each of the electromagnetic contactors 2*a* and 2*b*, it is possible to manufacture the electromagnetic contactor unit without significantly modifying the existing electromagnetic contactors 2*a* and 2*b*, and the strength in the lower case 6*a* is not reduced.

Note that, in the above-described embodiment, the description has been given of the case where the holding protrusion 42*d* formed between the engagement protrusions 42*b* and 42*c* of the connection piece 42 is cylindrical. However, the present invention is not limited thereto, and the holding protrusion 42*d* can be formed into a plate-like shape, or a conical or wedge-like shape which is tapered toward the lower end thereof. In addition, the holding protrusion 42*d* can also be omitted.

Moreover, in the above-described embodiment, the description has been given of the case where the curve portion 42*j* and the hook portions 42*k* are provided as the locked portions. However, the present invention is not limited thereto, and the hook portions 42*k* may be adapted to be vertically slidable, and the hook portions 42*k* may be biased upward using an elastic body such as a spring or the like.

Additionally, the formation position of the locking piece 44 formed in the piece accommodation concave portion 43 of each of the electromagnetic contactors 2*a* and 2*b* is not limited to the upper portion side of the piece accommodation concave portion 43, and the locking piece 44 may also be formed inside the piece accommodation concave portion 43 (side surface in the Y direction). In this case, the locked portions may be formed in left and right side portions of the connection piece 42, and the upper surface of the connection piece 42 may be brought into contact with the upper surface of the piece accommodation concave portion 43.

INDUSTRIAL APPLICABILITY

According to the present invention, it is possible to provide an electromagnetic contactor unit capable of firmly connecting electromagnetic contactors without influencing outer dimensions when the electromagnetic contactors are connected to each other.

EXPLANATION OF REFERENCE NUMERALS

2*a*, 2*b* . . . electromagnetic contactor, 3 . . . reversible unit, 3*a* . . . unit main body, 3*b* . . . contactor attachment portion, 3*c* to 3*f* . . . snap piece, 3*g* . . . unit attachment portion, 3*h* to 3*m* . . . connection hole, 6 . . . main body case, 6*a* . . . lower case, 6*b* . . . upper case, 6*c* . . . arc extinguishing cover, 6*c*1 lever support portion, 6*c*2 display window, 6*e* . . . contactor-side attachment allowance portion, 6*f* . . . contactor-side attachment prevention portion, 7 . . . contact portion, 7*a* . . . movable contact support, 7*a*1 . . . movement display piece, 7*b* . . . return spring, 7*c* . . . movable contact, 8 . . . electromagnet, 8*a* . . . coil, 8*b* . . . coil frame, 8*c* . . . fixed core, 8*d* . . . movable core, 9 . . . drive lever, 10 . . . terminal portion, 11 . . . coil terminal portion, 12 to 15 . . . connection hole, 31 . . . interlock mechanism, 32*a*, 32*b* . . . slide member, 33 . . . slide regulation member, 34 . . . rotation regulation member, 36*a*, 36*b* . . . movement display piece, 41 . . . attachment plate portion, 41*a* . . . attachment hole, 42 . . . connection piece, 42*a* . . . attachment plate portion, 42*b*, 42*c* . . . engagement protrusion, 42*d* . . . . . holding protrusion, 42*f*, 42*g* . . . side plate portion, 42*j* . . . curve portion, 42*k* . . . hook portion, 42*m* . . . engagement portion, 43 . . . piece accommodation concave portion, 44 . . . locking piece

What is claimed is:

1. An electromagnetic contactor unit wherein at least two juxtaposed electromagnetic contactors is connected with a connection piece, wherein each of the electromagnetic contactors comprises an attachment hole formed in each corner of an attachment plate portion, a piece accommodation concave portion fitting a half portion of the connection piece, formed above the attachment hole and accommodating within an outer dimension thereof, said piece accommodating concave portion opening to a connection surface with the adjacent electromagnetic contactor, and a locking portion locking the connection piece, formed in the piece accommodation concave portion, and the connection piece includes a pair of engagement protrusions individually engaging the adjacent attachment holes of the juxtaposed electromagnetic contactors, and a locked portion locked by the locking portion.

2. An electromagnetic contactor unit according to claim 1, wherein the connection piece at least comprises:

a connection plate portion formed with the pair of engagement protrusions on one surface, a pair of side plate portions formed on the other surface of the connection plate portion, a front plate portion connecting connection plate portion sides of the pair of side plate portions, and a curve portion curved from a tip of the front plate portion to a rearward side and having the locked portion formed to protrude at the tip.

3. A n electromagnetic contactor unit according to claim 1, wherein the piece accommodation concave portion is a concave portion formed for allowing an insertion of a tool for tightening a screw inserted into the attachment hole.

4. An electromagnetic contactor unit according to claim 1, wherein a holding protrusion is formed between the pair of engagement protrusions of the connection piece such that the holding protrusion serves as a holding portion by cooperating with the pair of engagement protrusions when inserted between the adjacent electromagnetic contactors.

5. An electromagnetic contactor unit according to claim 1, wherein each of the pair of engagement protrusions is formed into a C-shaped tubular shape formed by notching a cylindrical portion thereof on a side of a contact surface with the piece accommodation portion, and has a tapered portion formed on an outer peripheral surface of a tip side thereof.

6. An electromagnetic contactor unit according to claim 3, wherein a holding protrusion is formed between the pair of engagement protrusions of the connection piece such that the holding protrusion serves as a holding portion by cooperating with the pair of engagement protrusions when inserted between the adjacent electromagnetic contactors.

7. An electromagnetic contactor unit according to claim 3, wherein each of the pair of engagement protrusions is formed into a C-shaped tubular shape formed by notching a cylindrical portion thereof on a side of a contact surface with the piece accommodation portion, and has a tapered portion formed on an outer peripheral surface on a tip side thereof.

8. An electromagnetic contactor unit according to claim 3, wherein a holding protrusion is formed between the pair of engagement protrusions of the connection piece such that the holding protrusion serves as a holding portion by cooperating with the pair of engagement protrusions when inserted between the adjacent electromagnetic contactors, and each of the pair of engagement protrusions is formed into a C-shaped tubular shape formed by notching a cylindrical portion thereof on a side of a contact surface with the piece accommodation portion, and has a tapered portion formed on an outer peripheral surface on a tip side thereof.

* * * * *